US006105634A

United States Patent [19]

Liebram et al.

[11] Patent Number: 6,105,634

[45] Date of Patent: Aug. 22, 2000

[54] DEVICE FOR FILLING PACKAGES UNDER LOW GERM LEVEL CONDITIONS

[75] Inventors: Udo Liebram, Pfungstadt; Peter Sattler, Zwingenberg, both of Germany

[73] Assignee: Tetra Laval Holdings & Finance S.A., Pully, Switzerland

[21] Appl. No.: 09/257,314

[22] Filed: Feb. 25, 1999

[30] Foreign Application Priority Data

Feb. 27, 1998 [DE] Germany ..... 198 08 236

[51] Int. Cl.[7] ..... B65B 1/04; B65B 3/04; B67D 3/02

[52] U.S. Cl. ..... 141/91; 141/89; 141/90; 141/237; 141/238; 141/242; 141/244; 141/258

[58] Field of Search ..... 141/89–92, 85, 141/237, 238, 242, 244, 258; 134/166 R, 169 R, 166 C, 170

[56] References Cited

U.S. PATENT DOCUMENTS 5,267,591 12/1993 Wakabayashi et al. ..... 141/90

FOREIGN PATENT DOCUMENTS

| | | |
|---|---|---|
| 0 503 726 | 9/1992 | European Pat. Off. . |
| 785 134 | 7/1997 | European Pat. Off. . |
| 711288 | 9/1941 | Germany . |
| 970580 | 10/1958 | Germany . |
| 4219082 | 12/1993 | Germany . |
| 4224003 | 1/1994 | Germany . |
| 4304220 | 8/1994 | Germany . |
| 4313325 | 11/1994 | Germany . |
| 19648087 | 5/1997 | Germany . |
| 19612322 | 10/1997 | Germany . |
| 6-122428 | 5/1994 | Japan . |
| 2216885 | 10/1989 | United Kingdom . |
| 91/15401 | 10/1991 | WIPO . |

*Primary Examiner*—Henry J. Recla
*Assistant Examiner*—Timothy L. Maust
*Attorney, Agent, or Firm*—Michael L. Dunn

[57] ABSTRACT

A device for filling packages (10) with flowable products in low germ level conditions in a clean room (9) is described, with a product line (26), a filler valve (11) and a filler pipe (8) projecting into the clean room (9). In order that filling, with a low level of germs, of flowable contents into packages (10) is made possible without formation of condensation on filler pipes (8) and preferably in addition cleaning of the device directly in place without a great deal of assembly, the filler pipe (8), in its inlet area on the inlet aperture (15) in the top surface (14) of the clean room (9) is surrounded by a sleeve pipe (28) fitted at a distance coaxially, with inflow apertures (29) for air which is dry and has a low level of germs, and means (2–7) for producing and supplying the air which is dry and has a low level of germs are provided in the inflow apertures.

13 Claims, 4 Drawing Sheets

DEVICE FOR FILLING PACKAGES UNDER LOW GERM LEVEL CONDITIONS

BACKGROUND OF THE INVENTION a) Field of the Invention

The invention relates to a device for filling packages with flowable products under low germ level conditions in a clean room with a product line, a filler valve and a filler pipe projecting into the clean room.

b) Background Art

Filling devices are known which, although not operating under low germ level conditions, do have a filler valve and a filler pipe. Flowable products are also filled in using such devices, for example liquid foodstuffs such as milk, juice, or the like.

There is the desire in the food industry to make packages filled with liquid contents more long-lasting. There are already systems for this, for sterilizing milk and installations for aseptic filling thereof. The known filling devices used for this are susceptible of improvement in various respects. Known devices of this type are constructed in quite a complicated and costly manner, and are correspondingly difficult to use, apart from being sources of faults.

It has proved particularly disadvantageous that in operation, known filling devices form condensation, from the surrounding atmosphere, on the outside surface of the filler pipe because the product to be filled, for example, milk, is transported and filled at a lower temperature than the surrounding atmosphere. A temperature difference of even 5° or 10° C. is sufficient for condensation to form on the surface of the filler pipe. If liquid product is to be filled with a low level of germs, this formation of condensation must be prevented. The condensation comes from the outside atmosphere and inevitably contains bacteria which can drip with the condensation into the package.

In practice, a difference in temperature between the outside atmosphere and the product to be filled is often unavoidable.

The object of the invention is therefore to construct a device of the type described in the introduction for filling under low germ level conditions such that low germ level filling of liquid contents into packages is made possible without formation of condensation on filler pipes and preferably cleaning of the device is also made possible directly in place without needing a great deal of assembly.

BRIEF SUMMARY OF THE INVENTION

This object is solved according to the invention in that the filler pipe is surrounded in its inlet area on the inlet aperture on the top surface of the clean room by a sleeve pipe fitted at a distance coaxially, with inflow apertures for air which is dry and has a low level of germs, and means for producing and supplying the air which is dry and has a low level of germs are provided in the inflow apertures. The air with a low level of germs is sufficiently dried that, when flowing past the cool filler pipe, no condensation can form. The filling is consequently done under condensation-free and low germ level conditions.

DETAILED DESCRIPTION OF THE INVENTION

Figure 1:
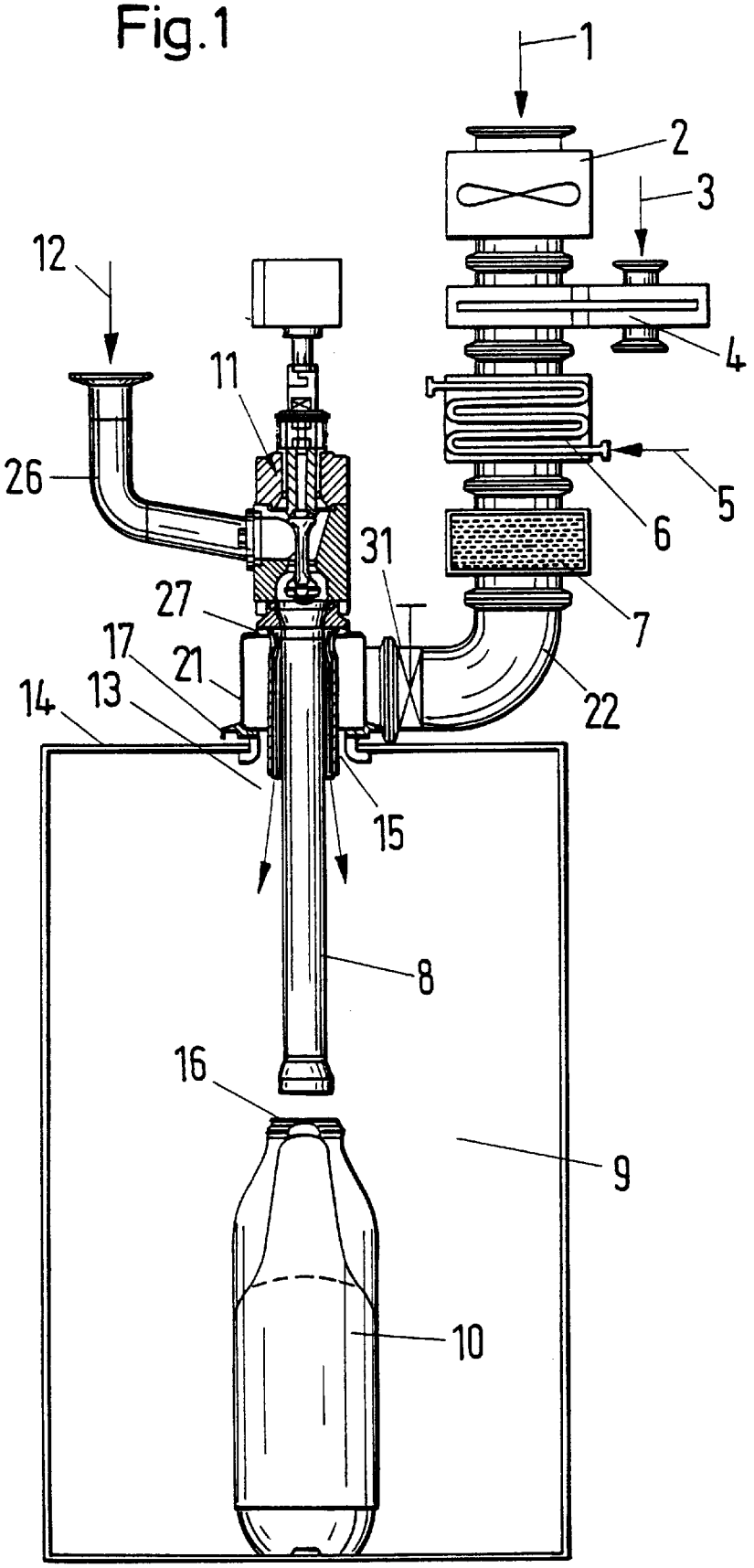
FIG. 1 the partly schematically represented cross-section view of a package being filled in a clean room with a filler pipe arranged above it, wherein the product line and also the supply line for air which is dry and has a low level of germs are shown connected.

For filling packages under low germ level conditions, it is advantageous to subject the packages to sterilizing and then, during the filling operation to keep them in a clean room to keep the bacteria per volume unit below a predetermined threshold until the package is sealed. It is also a prerequisite that the product to be filled in itself has a low level of germs. With the filling device according to the invention, the parts flowed through by the flowable product are also placed under low germ level conditions, in particular the filler valve, the feed line for the product and the filler pipe. The filler pipe and the package are kept in the clean room, and this is supplied with air with a low level of germs by means of the novel sleeve pipe according to the invention so the air in the clean room can be kept below the permissible value for the quantity of bacteria per volume unit.

The special feature of the invention is the sleeve pipe, which surrounds the filler pipe at a distance coaxially. The sleeve pipe has inflow apertures in which the air produced, which is dry and has a low level of germs, flows into the annular gap between the sleeve pipe and the upper portion of the filler pipe. The sleeve pipe is shorter than the filler pipe, that is to say the lower edge of the sleeve pipe terminates at a distance above the downstream end of the filler pipe. The filler pipe must be joined at its upstream end to the filler valve, and this is located outside the clean room and generally vertically above the clean room so that the liquid product, aided by gravity, can flow with at least one vertical component from above to below into the filler pipe, and from this into the empty package preferably located beneath it.

With the filling device being considered here, the package is completely closed apart from an aperture made at the top, and this aperture, which is used for filling, can be sealed aseptically and opened by the end-user for pouring.

In order to make the costs of the device low, the filler valve and the area of the filler pipe fitted to this on the inflow side are also located outside the clean room in the case of known filling devices. The teaching of the invention is thus to seal off the filler pipe at its inflow area from a bacterially rich or germ-containing outside atmosphere and to keep it sealed as far as the transfer into the clean room. It is precisely in this area of entry of the filler pipe that the novel sleeve pipe surrounds the filler pipe externally at a distance, and passes together with the filler pipe into the inlet aperture in the top of the clean room. Viewed in the direction of flow, after passing through this inlet aperture in the top surface, the filler pipe terminates in an open annular space, with the result that air, which is dry and has a low level of germs, blown from above through the inflow apertures can escape through this open, lower annular space between the filler pipe and sleeve pipe. It is evident that the harmful formation of condensation on the filler pipe can no longer occur. The dry air flowing around the sleeve pipe has a dew point which is lower than the temperature of the filler pipe.

Because the sleeve pipe is approximately only half or a third or a quarter of the length of the filler pipe, measured from the inlet side end of the filler pipe, with filling devices according to the invention, the filler pipe could even be moved by a relative movement with respect to the package into said package, without the novel sleeve pipe disadvantageously causing an enlargement of the diameter of the package opening. In addition, there is a saving in material for the manufacturing of the sleeve pipe without its function, namely the avoidance of germ-containing condensation, being affected in the least.

Using the means according to the invention for producing and supplying the dry air with a low level of germs, preferably, in a continuous manner during the filling operation, the entire package including the entire volume of the clean room is filled with this air, which is dry and has a low level of germs, with the result that even the filler pipe (and not only the annular space within the sleeve pipe) is filled with dry air with a low level of germs.

With known devices for filling under low germ level conditions there was no possibility of keeping the volume within the filling pipe filled with air with a low level of germs, and this was also not considered crucial. However, it proved that after completion of filling of the package, when the filler pipe was completely withdrawn from the head space of the package, the volume inside the filler pipe previously immersed in the head space had to be replaced by air flowing in from the outside. In this way germ laden outside air got into the head space below the package opening, and contributed to a considerable shortening of the life-time of the product. It was determined that approximately 50% of the head space was filled by the in-flowing, germ laden, outside air. This is a larger quantity than had previously been calculated. Using the means according to the invention, for producing and supplying air with a low level of germs though the annular gap in the sleeve pipe, and consequently also in to the head space of the filled package, the supply of germ laden outside air, mistakenly neglected until now, is prevented. The lifetime of a product filled in this manner according to the teaching of the invention can, in this way, be advantageously extended.

It is further advantageous according to the invention, when the means for producing and supplying the air with a low level of germs are provided with a ventilator, a dehumidifier and a sterile air filter arranged in a supply line, and the supply line, sealed off from the outside atmosphere, is connected to the inflow apertures in the filler pipe. Using the means described hereinabove for producing air which is dry and has a low level of germs, the filling device according to the invention can be operated almost anywhere and at any time. Outside air, possibly laden with germs and also possibly humid, can be sucked in by the ventilator as the dehumidifier arranged in the supply line ensures sufficient drying, and the sterile air filter arranged following it places the quantity of germs per volume unit below the respective permissible value. Consequently there is air which is dry and has a low level of germs which is conducted through the supply line described, the sleeve pipe and in particular there, the inflow apertures. In this manner a continuous flow of air which is dry and has a low level of germs is obtained along the outside surface of the filler pipe, in the clean room, even in the empty package and—when there is suitable preparation—also in the filler pipe. Although the clean room is largely sealed off from the outside air, it is not in any way hermetically sealed. When a certain over-pressure is produced in the clean room, compared to the outside atmosphere, air which is dry and has a low level of germs continuously flows out at the inlet apertures. The air which is dry and has a low level of germs sweeping past on the outside wall of the filler pipe prevents problematic condensation occurring, which then can longer drip into the package. In the case of metered filling, this contributes to the accuracy of metered filling.

In this connection, it is further advantageous when according to the invention when an air cooler is arranged in the supply line for air which is dry and has a low level of germs. In operations which in places and at times have to fill in liquids wherein the liquids are 5° or 10° C. colder than the air sucked in by the ventilator, it is easily conceivable that when the outside air conducted through the sterile air filter and the dehumidifier meets the surface of the filler pipe, it heats the filler pipe and the flowable foodstuff located therein. In order to prevent this disadvantage, the air cooler described is connected into the supply line for air with a low level of germs. The air cooler is connected following after the dehumidifier in the supply line. Thus, regardless of the temperature of the outside atmosphere, the filling device can be operated according to the invention such that, advantageously, the air which is dry and has a low level of germs is approximately at the same temperature as the product in the filler pipe.

In an advantageous further configuration of the invention, the sleeve pipe is surrounded by an outer distributor pipe connected to the inflow apertures in the sleeve pipe and to the supply line for air which is dry and has a low level of germs, sealed off from the outside atmosphere, and a seal is removably provided between the top surface of the clean room and the distributor pipe. On the one hand, this construction ensures a good seal against germ-laden outside atmosphere, in that transfer is done directly from the supply line for air with a low level of germs into the outer distributor pipe, which together with the sleeve pipe is sealed off from the outside such that the air which is dry and has a low level of germs can be pushed from the distributor pipe directly in to the inflow pipe and from this into the clean room. On the other hand, by means of this construction, there is a very practical and good possibility for cleaning the entire device in place. The dried and cooled air with a low level of germs keeps the space around the sleeve pipe and also around the filler pipe free of condensation and at a low level of germs, so only the lines coming into contact with the product, in particular the interior of the filler pipe, will need to be cleaned in place. Advantageously, a stop valve is provided on the outflow end of the supply line for the air which is dry and has a low level of germs, before the inlet into the outer distributor pipe, which can be closed off during cleaning so that all the spaces can have cleaning fluid applied to them without the sterile air filter, the air cooler or other equipment being damaged when producing the air which is dry and has a low level of germs.

By means of its removable fitting on the top surface of the clean room, the relevant housing for the clean room can easily be removed for cleaning without a large amount of assembly work and consequently time out of service having to be considered.

It is furthermore advantageous according to the invention when the outer distributor pipe is located on the inlet aperture of the top surface outside the clean room. The filler valve is advantageously arranged outside the clean room and downstream therefrom the distributor pipe is attached such that it is also outside the clean room, but is located on the inlet aperture of the top surface. By means of the arrangement of the sleeve pipe inside the outer distributor pipe, it is possible to seal the filler pipe on the side downstream of the filler valve from the outside atmosphere from outside the clean room, wherein the sleeve pipe is also partially outside the clean room. Nevertheless, there is no formation of condensation, as the air which is dried and has a low level of germs can sweep the spaces inside the sleeve pipe and inside the outer distributor pipe.

The device according to the invention is advantageously further configured such that the seal between the distributor pipe and clean room is fitted below the distributor pipe, and advantageously has a drip edge which terminates at a distance above the top surface of the clean room. The arrangement, which in a further advantageous manner is configured as a labyrinth seal, makes possible the draining away of any condensation liquid from the germ laden outside air as the drip edge is fitted below on the outer distributor valve, and diverts the condensation onto the top surface of the clean room such that dripping of the condensation into the clean room or somewhat onto the package, is reliably excluded. Configuration as a labyrinth seal allows the outlet of air which is dry and has a low level of germs from the clean room through the inlet opening thereof from above to below when maintenance of an overpressure of air with a low level of germs is provided by suitable means.

For cleaning in place, around the filler pipe, at a coaxial distance therefrom, a sealing pipe is furthermore removably fitted according to the invention, the lower end of which is provided with an outflow aperture for used cleaning agent. Thus, without a great deal of assembly, only the housing of the clean room needs to be removed from the seal on the outer distributor pipe, and the sealing pipe pushed over and fixed, for example, by snapping on over a clip ring on the lower outside surface of the sleeve pipe. Then, an annular space is created around the filler pipe which makes possible the sweeping past of cleaning fluid on the outside of the filler pipe, diversion through the lower outlet end of the filler pipe, and flowing of the cleaning fluid upwards in the interior of the filler pipe, until the important components and the filler valve are clean.

With this, it is advantageous when, according to the invention, several filler pipes spaced apart adjacently are arranged in the top surface of the clean room to form a multiple filler, and when all of them are connected through the same outer distributor pipe. The filling device according to the invention can indeed be configured as a single filler, but several single fillers can also be arranged adjacently. With high capacity machines it is, however, advantageous to arrange several stations adjacently and optionally to control them in a parallel manner, wherein the measures described allow very practical and low cost operation. The means for producing and supplying air which is dry and has a low level of germs, for example, can be used for a plurality of filling stations and does not require a dehumidifier, cooler and the like for each filling station. The same is true for simple cleaning in place. In addition, simplifications are produced by fitting the filler pipe to the machine, wherein the multiple fillers significant amounts of material and assembly can be saved.

As with the connection of the outer distributor pipe upstream to a supply line for air with a low level of germs and downstream to the inflow apertures of the plurality of sleeve pipes, with a further configuration of the invention, cleaning can also be simplified in that the outflow apertures open out into several sealing pipes in a collection pipe provided together with a drain. After cleaning, all the sealing pipes and all the spaces connected to them can be connected to the drain via the collection pipe, so that used cleaning agent can be collected and drained off. All vital parts can be cleaned simply and thoroughly in this manner.

Further advantages, features and possibilities for application of the present invention will be evident from the following description of preferred embodiments with reference to the attached drawings.

In the drawings, the following item numbers represent the corresponding listed items:

| | |
|---|---|
| 1 | inlet |
| 2 | ventilator |
| 3 | air inlet to the dehumidifier |
| 4 | dehumidifier |
| 5 | arrow |
| 6 | air cooler |
| 7 | sterile air filter |
| 8 | filler pipe |
| 9 | clean room |
| 10 | package |
| 11 | filler valve |
| 12 | arrow |
| 13 | arrow |
| 14 | top surface of the clean room |
| 15 | inlet aperture |
| 16 | filling aperture of the package |
| 17 | seal |
| 18 | groove |
| 19 | upper part of the seal |
| 20 | drip edge |
| 21 | outer distributor pipe |
| 22 | supply line for air with a low level of germs |
| 23 | cylindrical support |
| 24 | pressure chamber |
| 25 | lines for compressed air |
| 26 | product line |
| 27 | downstream end of the filler valve |
| 28 | sleeve pipe |
| 29 | inflow apertures |
| 30 | open annular space |
| 31 | sealing valve for air with a low level of germs |
| 32 | sealing pipe |
| 33 | clip ring |
| 34 | outflow aperture |
| 35 | collecting pipe |
| 36 | drain |
| 37 | direction of flow of the cleaning agent |

A package 10 to be filled with flowable foodstuffs, for example, milk, at a temperature of approximately 4° C., stands on the base of the housing, which is not described in more detail, of the clean room 9. Its top surface 14 is provided with an inlet aperture 15.

Figure 2:
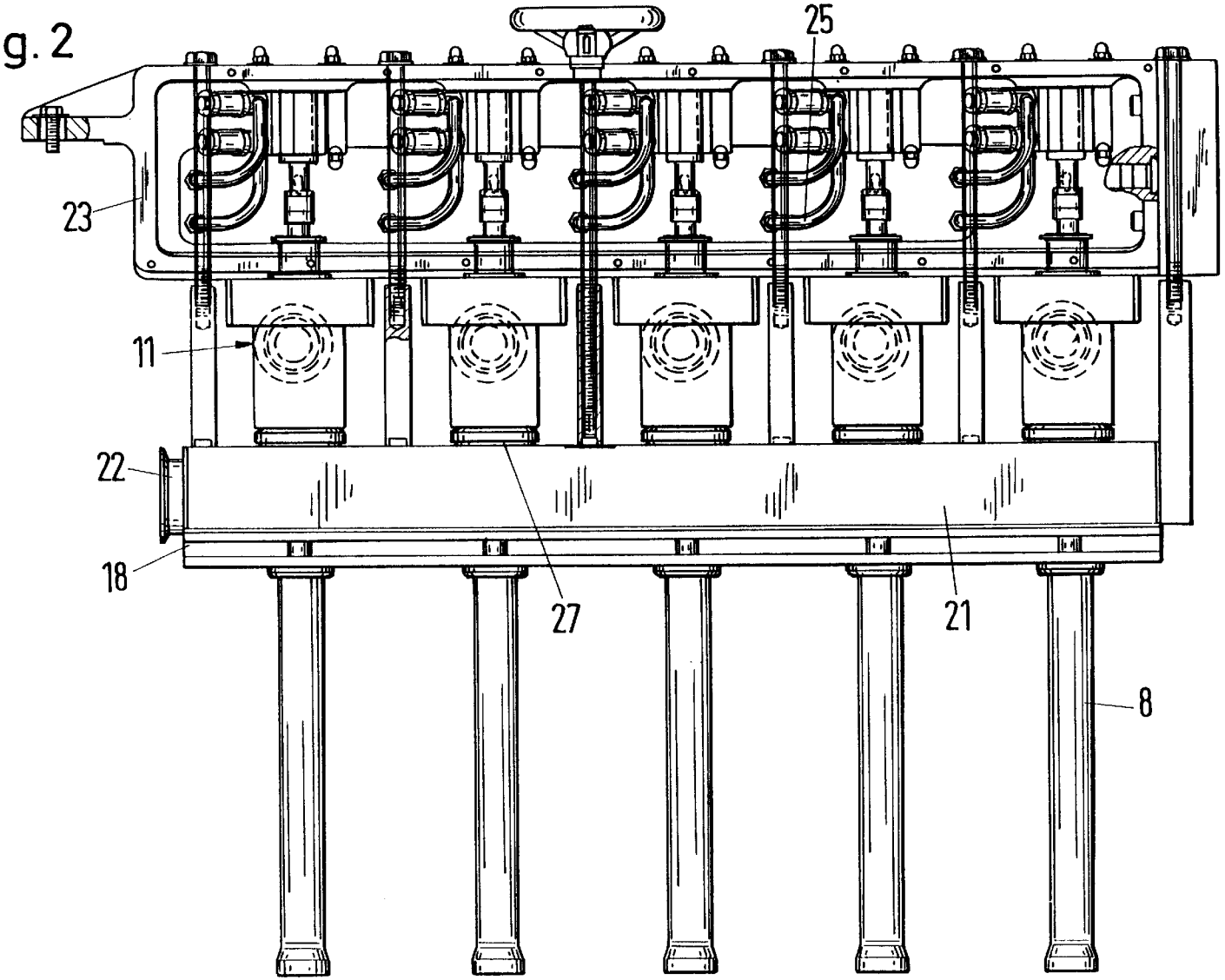
FIG. 2 the side view of a multiple filler, wherein the supply line opens out at its end face into the outer distributor pipe, and five filling stations are provided, FIG. 3 a view similar to FIG. 1, wherein however the means for producing air which is dry and has a low level of germs are omitted and for cleaning in place, the housing of the clean room is replaced by a sealing pipe, which is connected on the outlet side to a collection pipe with a drain, and FIG. 4 a view similar to FIG. 2, wherein however the cleaning operation is shown, that is to say the five filling stations are connected to the common collection pipe with the drain.
Figure 4:
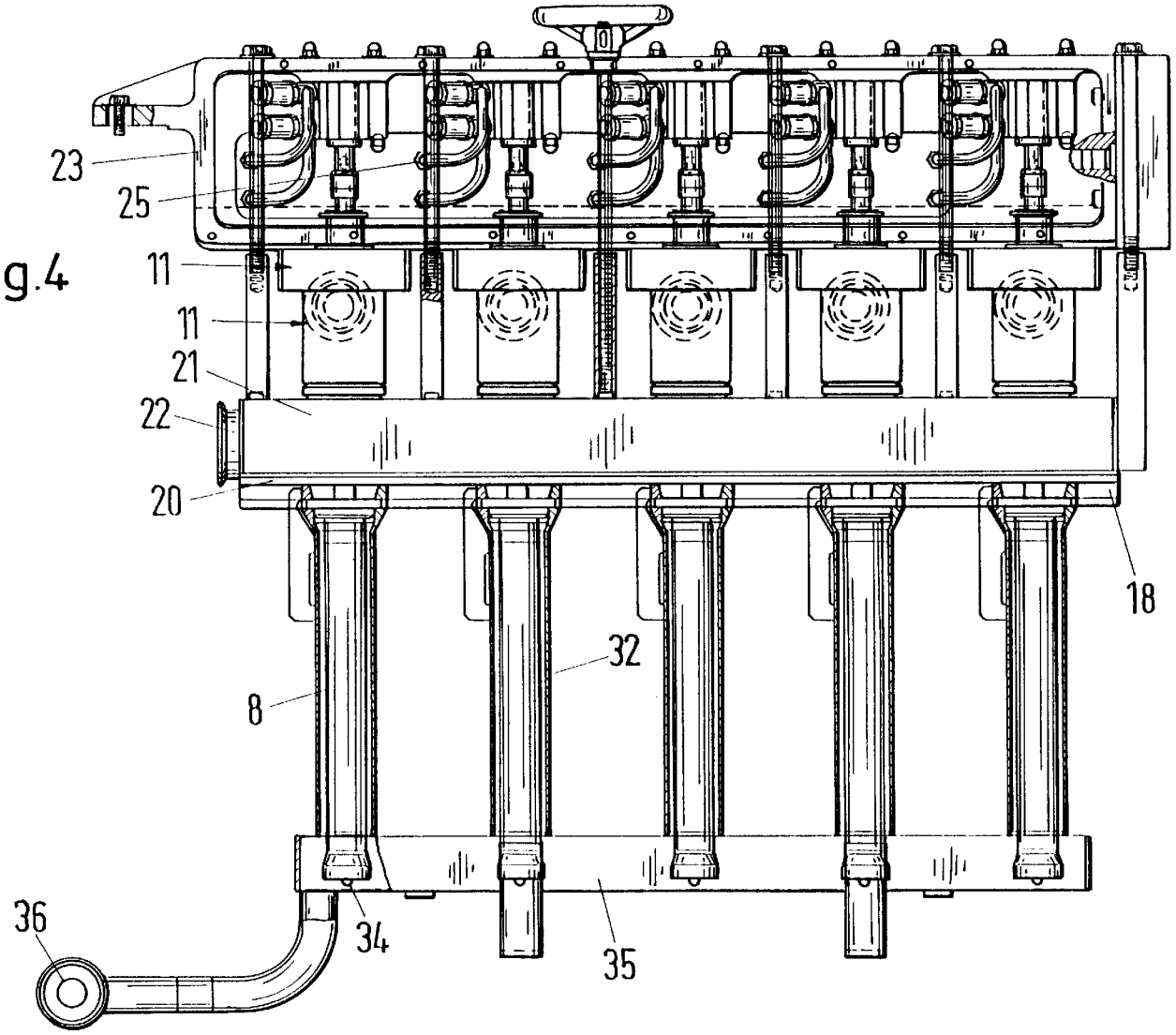

It can be seen from FIGS. 2 and 4 that the present embodiment is a multiple filler with five filling stations, each of which has a filler pipe 8. These filler pipes 8 go in from above from the space outside the clean room 9 through the inlet aperture 15 downwards, wherein the respective filler pipe 8 ends up at a distance in motion above the filling aperture 16 of the package 10. The five filler pipes 8 are in a line one behind another, for which reason the inlet aperture 15 is elongate and extends from the frontmost to the rearmost filler pipe 8. Correspondingly, the seal labelled 17, constructed in a labyrinth-like manner, is elongate. From FIGS. 2 and 4, for example, the groove 18 also configured in an elongate manner can be seen, in which the opposite edges of the top surface 14 of the clean room 9 are inserted in the filling operation (FIG. 1). The upper part 19 of the seal 17 running downwards sloping like a roof is configured externally as a drip edge 20 which according to FIG. 1 clearly terminates at a distance above the top surface 14 of the clean room 9. The upper part 19 of the seal 17 is fixed to an outer distributor pipe 21 with a rectangular cross-section. The lower part of the seal 17 forming the groove 18 is removably connected to the top surface 14. Again from FIGS. 2 and 4, it can be seen how the outer distributor pipe 21 and also the strip-shaped seal 17 extend along over all five filler pipes 8.

With the embodiment of FIGS. 2 and 4, the supply pipe 22 for air which is dry and has a low level of germs terminates at an end face, while in the embodiment of FIG. 1, it is placed laterally.

The filler pipe 8 is connected to the filler valve generally labelled 11, the individual elements of which are not described in more detail, as they are known to the skilled person. It is indicated only that the control of the filler valve 11 is done by compressed air supplied to the pressure chamber 24 in the cylindrical support 23. The lines 25 shown in FIGS. 2 and 4 conduct this compressed air.

By actuating the filler valve 11, the connection between the inside of the filler pipe 8 and the product line 26 is opened or closed.

On the downstream end 27 of the filler valve 11, not only is the filler pipe 8 fixed inside, extending vertically, but also a so-called sleeve pipe 28 with inflow apertures 29 distributed regularly on the periphery. This sleeve pipe 28 is shorter than the filler pipe 8, being approximately only 10–30% of the length of the filler pipe 8, but having a larger diameter, such that an open annular space 30 is produced at the downstream end of the sleeve pipe via which air which is dried and has a low level of germs can exit in accordance with the arrow 13 in FIG. 1 into the clean room 9, when it is ensured that the air with a low level of germs can enter at the top through the inflow apertures 29 into the sleeve pipe 28. The sleeve pipe 28 is closed at the top.

The sleeve pipe is surrounded in the area above the top surface 14 of the clean room 9 by the outer distributor pipe 21 in a manner sealing it off from the outside atmosphere. In the lower area on the inlet aperture 15 in the top surface 14, the seal 17 ensures sealing off from the outside atmosphere. Both the inside and the outside of the sleeve pipe 28 is thus sealed off from the outside atmosphere. The inside of the outer distributor pipe 21 is connected to the supply line 22 for air which is dry and has a low level of germs via a sealing valve 31. During the normal filling operation this sealing valve 31 is opened so that dry air with a low level of germs can flow into the outer distributor pipe 21 and via the inflow apertures in the sleeve pipe 28.

This air which is dry and has a low level of germs is produced in that normal air, for example, even air which is humid and contains germs, is sucked in at the inlet 1 by a ventilator 2 and is pushed through a dehumidifier 4 into an air cooler 6. At 3, the air inlet for the dehumidifier 4 is shown, and the arrow 5 represents the entry of cooling water into the air cooler 6. With the embodiment according to FIG. 1 shown here, a sterile air filter 7 is fitted following the air cooler 6, so in the bends of the supply line 22, arranged below, dry and cold air with a low level of germs is available, which is designated herein as "air with a low level of germs".

If, for example, milk with a product temperature of approximately 4° C. is supplied according to the arrow 12, the dry air leaving the dehumidifier at a temperature of approximately 30° to approximately 35° can be cooled down by the air cooler 6 to a temperature of approximately 3° to 4° C., at which the dry air then enters into the sterile air filter 7.

The normal operation of a filling device according to FIG. 1 takes place such that using the means described hereinabove, dry air with a low level of germs is produced and conducted via the supply line 22 to the inside of the sleeve pipe 28. This dried, cooled air with a low level of germs enters into the clean room 9 in accordance with the arrow 13, flowing around the outside surface of the filler pipe 8, fills said clean room, fills the package 10 and disperses through unsealed points inevitably present and through the labyrinth seal 17 into the outside space. The filling with milk is done by actuating the filler valve 11 in a known manner. This filling can also be carried out with a multiple filler according to FIGS. 2 and 4 in the same way. It is always a prerequisite that the package 10 has also been previously cleaned and sterilized, as has the flowable product and the line conducting the air with a low level of germs. While in the filling operation the filler valve 11 alternately opens and closes, the sealing valve 31 is open for the air with a low level of germs.

Figure 3:
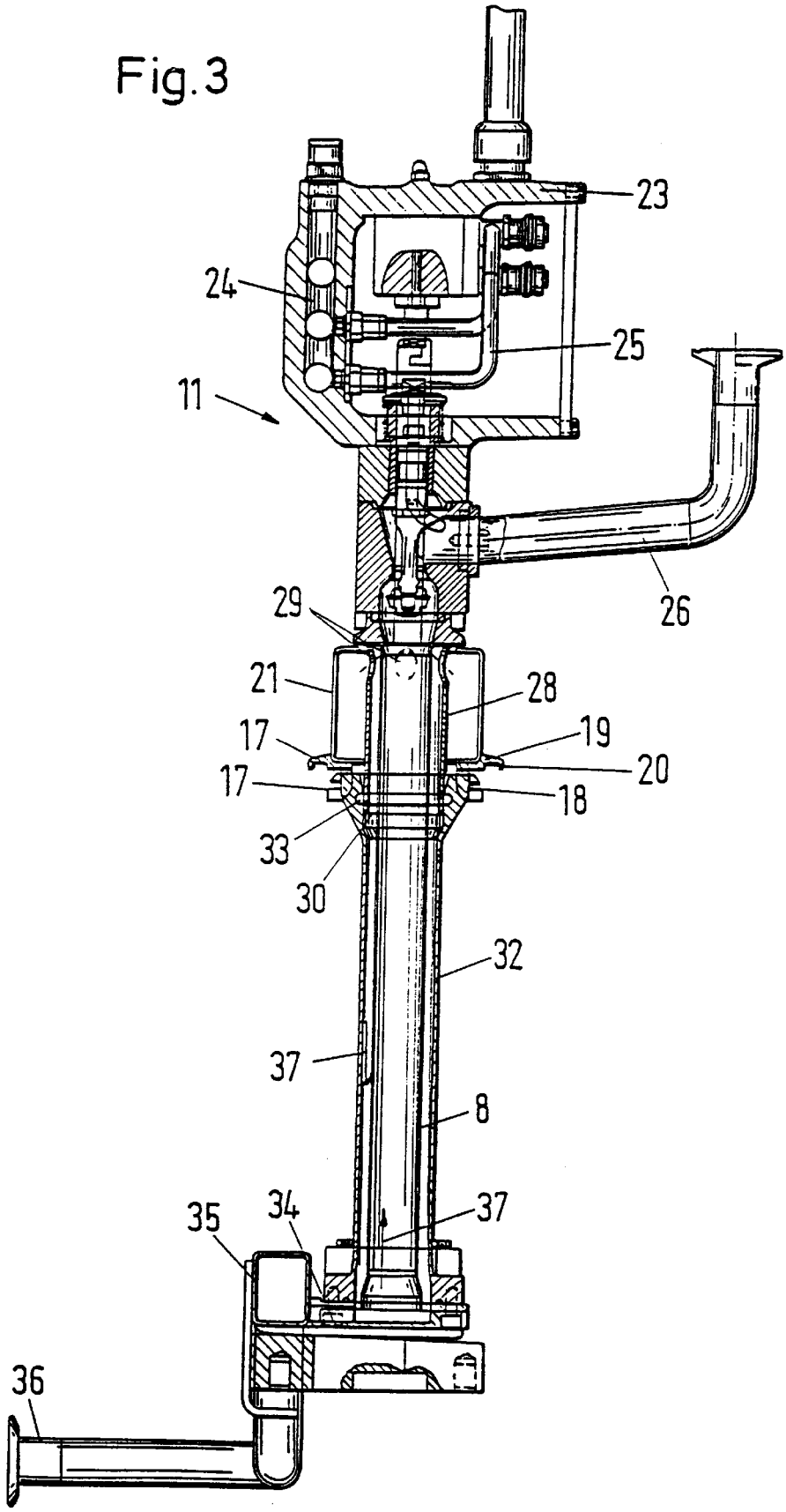

For cleaning in place, a distributor pipe 32 is removably fitted around the filler pipe 8 at a distance coaxially thereto. This is shown only in FIGS. 3 and 4. After removal of the housing of the clean room 9, for example by pushing the top surface 14 out of the groove 18 of the seal 17, pushed from below over the filler pipe 8, until at the top a clip ring 33 is snapped on and holds the sealing pipe 32. At the lower end of both the sealing pipe 32 and the filler pipe 8, an outflow aperture 34 ensures connection with a common collecting pipe 35 for used cleaning agent. This can be emptied through a sealable drain 36.

In the cleaning operation, the sealing valve 31 for air which is dry and has a low level of germs is closed and cleaning agent conducted through the product line 26 in the direction of the arrow 12. The cleaning agent flows through the inflow apertures 29 in the sleeve pipe 28 both in the outer distributor pipe 21 and the sleeve pipe 28, in order to flow outside around the filler pipe 8 in the direction of flow 37, to be diverted at its lower outlet end and also to flow upwards again in the opposite direction of flow 37 in the inside of the filler pipe 8, where when the filler valve 11 is open it again exits from the product line 26.

Only a few assembly stages are necessary for removing the sealing pipe 32 from the filler pipe 8, to place the clean room 9 in the seal 17, and then to take up the normal filling operation.

Naturally, prior to this, the cleaning agent circulating for some time is let out by opening the drain 36.

What is claimed is:

1. A device for filling packages (10) with flowable products in low germ level conditions in a clean room (9) with a product line (26), said device comprising a filler valve (11) and a filler pipe (8) adapted to project into the clean room (9), wherein the filler pipe (8), at an inlet area on an inlet aperature (15) in a top surface (14) of the clean room (9), is spaced from and is coaxially surrounded by a sleeve pipe (28), said sleeve pipe (28) being provided with inflow aperatures (29) for air which is dry and has a low level of germs, and means (2–7) for producing and supplying the air which is dry and has a low level of germs to inflow aperatures (29).

2. A device according to claim 1 wherein for forming a multiple filler, several filler pipes (8) are arranged adjacently at a distance apart in the top surface (14) of the clean room (9) and are all connected through the same outer distributor pipe (21).

3. A device according to claim 1 wherein, for cleaning in place, a sealing pipe (32) is removably fitted around the filler pipe (8) at a distance coaxially thereto, the lower end of which is provided with an outflow aperture (34) for used cleaning agent.

4. A device according to claim 3 wherein for forming a multiple filler, several filler pipes (8) are arranged adjacently at a distance apart in the top surface (14) of the clean room (9) and are all connected through the same outer distributor pipe (21).

5. A device according to claim 4, wherein the outflow apertures (34) of several sealing pipes (32) open out into a common collecting pipe (35) provided with a drain (36).

6. A device according to claim 1, wherein the means (2–7) for producing and supplying the air which is dry and has a low level of germs comprises a ventilator (2), a dehumidifier (4) and a sterile air filter (7) arranged in a supply line (22), and the supply line (22), sealed off from the outside atmosphere, is connected to the inflow apertures (29) in the sleeve pipe (28).

7. A device according to claim 6 wherein an air cooler is arranged in the supply line (22) for air which is dry and has a low level of germs.

8. A device according to claim 6 wherein the sleeve pipe (28) is surrounded by an outer distributor pipe (21) connected to the inflow apertures (29) in the sleeve pipe (28) and to the supply line (22) for air which is dry and has a low level of germs, sealed off from the outside atmosphere, and that a seal (17) is removably provided between the top surface (14) of the clean room (9) and the distributor pipe (21).

9. A device according to claim 8 wherein the outer distributor pipe (21) is located on the inlet aperture (15) of the top surface (14) outside the clean room (9).

10. A device according to claim 8 wherein the seal (17) is fitted between the distributor pipe (21) and the clean room (9) at the bottom on the distributor pipe (21) and has a drip edge (20) externally, which terminates at a distance above the top surface (14) of the clean room (9).

11. A device according to claim 8 wherein the seal (17) is configured as a labyrinth seal.

12. A device according to claim 6 wherein, for cleaning in place, a sealing pipe (32) is removably fitted around the filler pipe (8) at a distance coaxially thereto, the lower end of which is provided with an outflow aperture (34) for used cleaning agent.

13. A device according to claim 6 wherein for forming a multiple filler, several filler pipes (8) are arranged adjacently at a distance apart in the top surface (14) of the clean room (9) and are all connected through the same outer distributor pipe (21).

* * * * *